US008819994B2

(12) United States Patent
Ingram

(10) Patent No.: US 8,819,994 B2
(45) Date of Patent: Sep. 2, 2014

(54) SPACE ENCLOSURE SYSTEM

(75) Inventor: Neil Ingram, Malaga (ES)

(73) Assignee: Glass Curtains USA, Vista, CA (US)

( * ) Notice: Subject to any disclaimer, the term of this patent is extended or adjusted under 35 U.S.C. 154(b) by 541 days.

(21) Appl. No.: 12/990,147

(22) PCT Filed: Jan. 30, 2009

(86) PCT No.: PCT/ES2009/000047

§ 371 (c)(1),
(2), (4) Date: Oct. 28, 2010

(87) PCT Pub. No.: WO2009/095519

PCT Pub. Date: Aug. 6, 2009

(65) Prior Publication Data

US 2011/0088326 A1 Apr. 21, 2011

(30) Foreign Application Priority Data

Feb. 1, 2008 (ES) ..... 200800273

(51) Int. Cl.

| | |
|---|---|
| ***E05D 15/20*** | (2006.01) |
| ***E04B 2/82*** | (2006.01) |
| ***E05D 15/06*** | (2006.01) |

(52) U.S. Cl.

CPC ..... *E04B 2/827* (2013.01); *E05Y 2800/412* (2013.01); *E05Y 2800/67* (2013.01); *E05Y 2900/142* (2013.01); *E05D 15/0682* (2013.01); *E05Y 2800/205* (2013.01); *E05Y 2900/15* (2013.01); *E05Y 2201/684* (2013.01)

USPC ..... 49/130; 49/125; 49/128

(58) Field of Classification Search

USPC ..... 49/125, 127, 128, 129, 130

See application file for complete search history.

(56) References Cited

U.S. PATENT DOCUMENTS

| | | | | |
|---|---|---|---|---|
| 3,334,375 | A | 8/1967 | Eugene | |
| 4,573,286 | A | 3/1986 | Favrel et al. | |
| 5,548,926 | A * | 8/1996 | Sjoholm | 49/127 |
| 5,749,172 | A * | 5/1998 | Isopahkala | 49/127 |

(Continued)

FOREIGN PATENT DOCUMENTS

| | | | |
|---|---|---|---|
| ES | 2038942 | A6 | 8/1993 |
| FR | 2557624 | A1 | 7/1985 |
| JP | 2008002061 | A | 1/2008 |
| JP | 2008002160 | A | 1/2008 |

(Continued)

OTHER PUBLICATIONS

International Search Report, dated Jun. 8, 2009, from corresponding PCT application.

*Primary Examiner* — Katherine Mitchell
*Assistant Examiner* — Catherine A Kelly
(74) *Attorney, Agent, or Firm* — Young & Thompson

(57) ABSTRACT

An enclosure system includes a plurality of elongated panels consecutively connected to one another. The plurality of elongated panels includes a plurality of independent panels and a panel-door. The enclosure system also includes an upper track constructed and arranged to receive an upper portion of the plurality of elongated panels and a lower track constructed and arranged to receive a lower portion of the plurality of elongated panels. The lower track includes two polytetrafluoroethylene (PTFE) strips constructed and arranged as a transport system for facilitating movement of the plurality of elongated panels along the upper track and the lower track by achieving a very low coefficient of friction enabling heavy weights to be moved with little effort. Substantially all weight of the plurality of elongated panels is supported evenly across a length of the lower track on the two PTFE strips.

15 Claims, 10 Drawing Sheets

(56) References Cited

U.S. PATENT DOCUMENTS

| | | | | |
|---|---|---|---|---|
| 6,397,522 | B1 * | 6/2002 | Nussbaum | 49/127 |
| 6,618,994 | B1 * | 9/2003 | Nussbaum | 49/180 |
| 6,969,825 | B2 * | 11/2005 | Silvestro | 219/133 |
| 7,260,916 | B2 * | 8/2007 | Sarnell et al. | 49/409 |

FOREIGN PATENT DOCUMENTS

| | | | |
|---|---|---|---|
| WO | 9012128 | A1 | 10/1990 |
| WO | 9846851 | A1 | 10/1998 |
| WO | 2004022897 | A1 | 3/2004 |

* cited by examiner

SPACE ENCLOSURE SYSTEM

BACKGROUND OF THE INVENTION

1. Field of the Invention

This invention relates to a system of closure panels able to divide, isolate or compartmentalize spaces in houses, offices, shops, etc. via a flexible system based on glass and aluminum. For this reason, the invention is directed to the technical area of construction, more precisely in the area of enclosures to divide spaces and to enclose spaces on terraces, balconies, rooms, etc.

2. Description of the Related Art

Within the above described technical area, there are well known systems of enclosure mainly based on a set of panels that hang from upper rails on the ceiling and that move with the help of bearings and other mechanical elements. These devices present several problems and limitations related to not only the reliance on gears and bearings, but also from the fact that the weight of the panels rests on the upper rails and not on the floor. For example, in all of these systems, the bearings and gears wear out over time and use, which makes it necessary to carry out periodic maintenance of them. Moreover, the weight of the panels can result on malformations on the upper rail at the points of contact, in which the weight of these panels rests. Accordingly, the useful life of such enclosure systems is considerably limited. Specific examples of these systems are described on patent WO 90/12128 or in the French document FR2.557.624.

BRIEF SUMMARY OF THE INVENTION

The current invention aims to solve the problems mentioned above by developing an enclosure system in which the weight of the panels rests and moves on the PTFE strips, thus eliminating the need for bearings and gears.

The solution presented below is based in a set of elongated panels that move individually, guided by an top guide and a bottom guide, and in which the weight of each of the panels rests longitudinal and uniformly throughout the lower rail. This structure aims to avoid places in which there is an excessive pressure, as well as mechanical elements vulnerable to suffer failures due to bearings.

The set of elongated panels includes a panel-door and a set of independent panels. Generally, the panel-door is the last panel of the elongated panels and it does not move longitudinally from the pick-up position. The panel-door construction and arrangement is similar to the one of the other elongated panels, though it also includes a system of closure. The independent panels includes are made of toughen glass, between 10 and 30 mm thick. The panels include a set of elements that allow them to move along an upper track and a lower track located one in front of the other, on the ceiling and the floor of a room, terrace, shop, etc. The panels move along these tracks with the help of some guides, and the weight of the whole structure only rests and moves on the PTFE strips. For this reason, the only function of the upper track is to guide the movement of each panel and not to be a weight bearing element. The independent panels can be moved by a person along the tracks. Additionally, they can rotate along an axis by one of the lateral sides of the independent panel in such a way that the independent panel can be placed in a position perpendicular to the tracks. The rotation or opening of the panels in this perpendicular orientation occurs at the end of the tracks. Alternatively, when the panels are extended, the elongated panels act to enclose a desired space.

Between these two extreme positions a variety of intermediary positions may be utilized depending on the needs of a user.

The upper end of the glass is protected by a profile in the form of an aluminum frame that has two outer arms stuck to the glass and a trapezoid structure, the wide side of which is open, while the narrow side of the trapezoid structure connects to the outer arms of the profile. Because of the opening of the wide side of the trapezoid structure, a set made up of three pieces comes out, which make up the upper side of the top flag. These three pieces are:

a) A top flag screw made of, for example, stainless steel and with the shape of a "T"; the head of the "T" screw is oval and has 2 elongated and straight sides.

b) A circular section made of, for example, plastic located inside the track. The circular section is a unitary piece made of, for example, polyamide or a similar material and it consists of two cylindrical layers of different diameter. The lower layer of the circular section has a larger diameter and is in touch with the inner walls of the upper track. The upper layer of the circular section has a smaller diameter. The circular section defines a central opening threaded and sized to receive the top flag screw.

c) A cylindrical spacer piece made of, for example, plastic that is in touch with the wide side of the trapezoid structure of the profile and the lower layer of the circular section acting as stop between the two of them; this component is centrally bored to accommodate the top flag screw.

A metal sheet is disposed within the hollow trapezoid structure of the profile. The metal sheet defines three threaded holes one of which connects to the top flag screw after it passed through the trapezoid opening in the wide side of the trapezoid structure. The metal sheet is rectangular; three of its sides are straight and the other one is slightly curved. The top flag screw drives into the perforation of the metal sheet which is nearest to the curved side, which is also the nearest side to the prominent end of the panel or the panel-door. This upper metal sheet is located in a determined place along the hollow of the trapezoid structure with the help of two stud screws that drive into the ends of the sides that make up the opening to the hollow of the trapezoid structure, and on the other two threaded hollows of the metal sheet. The upper metal sheet's function is to keep the profile and the upper track together with the help of the set of pieces that make up the top flag. These pieces are not sized to support the weight of the elongated panel, since the panel in the base of the device.

The upper track has a substantially rectangular or squared cross section with its lower side defining an elongated opening through which the top flag passes. The elongated opening is limited by the equidistant sides of the upper track. The upper track is attached to the ceiling via nails, screws or other similar elements that drill a slot in the shape of a channel located in the inner face of an upper side of the upper track.

The lower side of the glass is protected by a lower aluminum profile similar to the upper one. The glass is attached to this profile in the same way that it is attached in the upper side. The upper side of the profile includes the outer arms of the profile, the narrow side of the trapezoid structure and the pair of outer arms defining a recess where the weight of the glass rests. The hollow trapezoid structure has a wide side, a narrow side, and two slanted sides. The wide side of the trapezoid structure defines a trapezoid opening centered between two extensions of the wide side. Within the trapezoid structure a metal sheet similar to the one introduced in the upper side of the panel is placed. A bottom flag screw is driven into the metal sheet and it goes through a component called the bush, made of, for example, polyamide or a similar material, which allows the longitudinal movement along the lower track. The bottom flag screw, the metal sheet, and the bush forms the bottom flag. This bush is a unitary piece and it comprises four cylindrical layers of different diameter:

- the first cylindrical layer is at a lowest level of the four layers and has a largest diameter of the four layers. The first cylindrical layer is in contact with the inner walls of the lower track.
- The second cylindrical layer is constructed and arranged as a step above the first cylindrical layer.
- The third cylindrical layer is disposed above the second cylindrical floor and has a diameter being equal to a width of a second elongated opening of the lower track.
- The fourth cylindrical floor is disposed above the third cylindrical floor and has a diameter being slightly larger than the width of the second elongated opening of the lower guide track.

The lower track has a substantially rectangular or squared cross section with its upper side defining an elongated opening through which the bottom flag passes. The elongated opening of the lower track is limited by the equidistant sides of the lower track. It is on these equidistant sides of the lower track that slots of, for example, 4 mm are made in such a way that they are equidistant to a central dividing line of the lower track, and in which PTFE strips interfacing with the lower profile are fitted. In this way, the weight of each elongated panel rests over these PTFE strips. The lower track is attached to the floor similarly to the upper track, with the help of a nail that goes through the longitudinal channel made along the lower side of the lower track.

Inside the trapezoid structure of the lower profile wherein the metal sheet is introduced a worm screw is fitted across the metal sheet; this worm screw includes, at least, two other elements that are introduced within the lower track. These elements, together with the guide component and the worm screw, allow a fine adjustment of the elongated panel in the lower track in order to obtain an optimum assembly between the profile and the PTFE strips over which the weight of the elongated panel rests, thus allowing an adequate movement of the elongated panel.

The structure of the panel-door is slightly different from the rest of the elongated panels, since at first it does not move along the tracks. The upper end of the glass of the panel-door is protected by an aluminum profile; the outer arms of said profile are attached to the glass and have a trapezoid structure, the upper side of which is open and corresponds to the wide side, while the base is the narrow side that attaches to the outer arms of the profile. Inside the trapezoid structure, the metal sheet is attached via a worm screw. A square block made of polyamide or a similar material is attached to the metal sheet via a stop screw. This square block has a section with rounded corners, in order to enable the attachment at a lower and upper part of the square block. The inside part of this square block is hollow and circular, and the heads of two screws, the stop screw and an anchoring screw (the threads of which come out by the lower and upper opening of the square block) are located there. The upper opening in touch with the roof of the upper guide track has a smaller diameter than the head of the anchoring screw that goes through the roof of the upper track and threads in a nut located in the roof of the room. The stop screw comes out through the lower opening of the square block, the circular side of which has a larger diameter than the heads of the anchoring and stop screws; this allows the fitting of the heads of both screws within the square block.

The lower side of the panel-door contains the same elements arranged within the profile (the base of which is trapezoidal-shaped) and the lower track. These lower and upper tracks allow the rotation of the panel-door in both ways and are in touch with the lateral sides of the open edge of the upper track. With the help of the worm screw, the panel-door can be fastened to the upper track. As in the rest of the panels, these components are not sized to support the weight of the panel-door, since the panel-door rests in the base of the device.

On both the panel-door and the independent panels, the upper side of the end that is opposite to the spin axis includes a top guide that is made up by a top guide screw that goes through a cylindrical hollow piece made of, for example, polyamide and located in the hollow part of the upper track. The top guide has a diameter that coincides with the elongated opening of the upper track. The top guide ends on its upper side with a widening of its inner thread in such a way that it coincides with the perimeter of the head of the top guide screw. This screw goes through the hollow of the upper profile trapezoid structure that protects the glass and is driven into a thread of the metal sheet located inside the upper profile trapezoid structure. The metal sheet is rectangular and has two threads equidistantly located along its longitudinal axle. On the other side, in the lower track, the lower sides of the lower profile trapezoid structure that protect the glass rest on the PTFE strips located in the channels of the lower track.

Moreover, a bottom guide, with the shape of an "H", is partially introduced between the sides that define the hollow part of the lower profile trapezoid structure in such a way that a lower outer cylindrical layer of the bottom guide covers the opening of the lower track, without making the weight of the panel rest over the bottom guide in the inner borders that define the hollow of the lower track. In this way, the bottom guide does not rest over the PTFE strips, but it does cover the opening of the lower track. The washer is attached to the profile with the help of a screw that goes across the threaded hollow through the longitudinal axis to the bottom guide and goes up to the base of the lower profile trapezoid structure.

The central side of the upper track that coincides with the panel-door has a gap in which a turning mechanism based in a series of circular recesses that house the heads of the T-shaped screws is located, so as to enable the rotation and opening of the independent panels when these are picked up in the end of the enclosure system.

In the upper track side that coincides with the end of the panel-door—opposite to the wall—a slot is made, in which a turning arm in the form of an arm-shaped plate is placed. The hollow made in the upper track allows the sheet and their profiles to come out from the plan made up by the upper tracks when these are picked up in the end of the enclosure system. The circular recesses, together with some turning arms that spread perpendicularly to the upper track through the hollow made in said track, enable the panels to rest and avoid them from rotating.

The rotating movement begins when the head of the top flag screw is introduced and fitted within the circular recess of the turning mechanism located at the end of the track, in the vicinity of the panel-door. The sinking within the circular recess establishes and secures the exact point through which the spin axis passes and in which the spin movement of the panel-door or panel will take place. Besides, the looseness of the sinking within the circular recess allows a slight swinging of the panel-door, which eases the opening of the panel or the panel-door. When an elongated panel rotates, it rotates through the spin axis defined by the top flag and bottom flag, and the sheet rotates as well, driving the weight of the glass that the profile receives to the bottom guide. When the bottom guide moves, it is moved above the lower track opening, abandoning it for a notch made in the PTFE. On the other side, the top flag can only abandon the upper track through the hollow made near the wall.

The panel-door includes a handle that allows the opening of the window fitted into the spin arm and that is used, together with the closure of the inner side, to open, close or block the panel-door, thus allowing the system to be completely shut, without making it possible to open it from the outside.

In some arrangements, the system is prepared to support panels up to 3 meters high, in which each sheet can weight up to 50 kg. Moreover, the dimensions of the glass are limited to a width of 10 to 30 mm, because with these conditions and because of the use of the aluminum profiles found of the market, it is possible to obtain the best mechanical behaviors for the system.

The movement and displacement of each panel is manually carried out by a person. The rotation and displacement of each panel will allow an easy cleaning of both faces. Besides, the maintenance of this structure is simple, because no wheels, bearings or drivings that might wear out are used.

The stripes over which each panel rests and moves along the tracks are made up of PTFE, since this material allows an easy movement of the panels, with mechanical properties resistant to abrasion and wear. These strips are fixed to the lower section. The behavior of the PTFE in touch with the aluminum surfaces allows the simple and easy movement of the system.

DETAILED DESCRIPTION OF THE PREFERRED EMBODIMENTS

Figure 1:
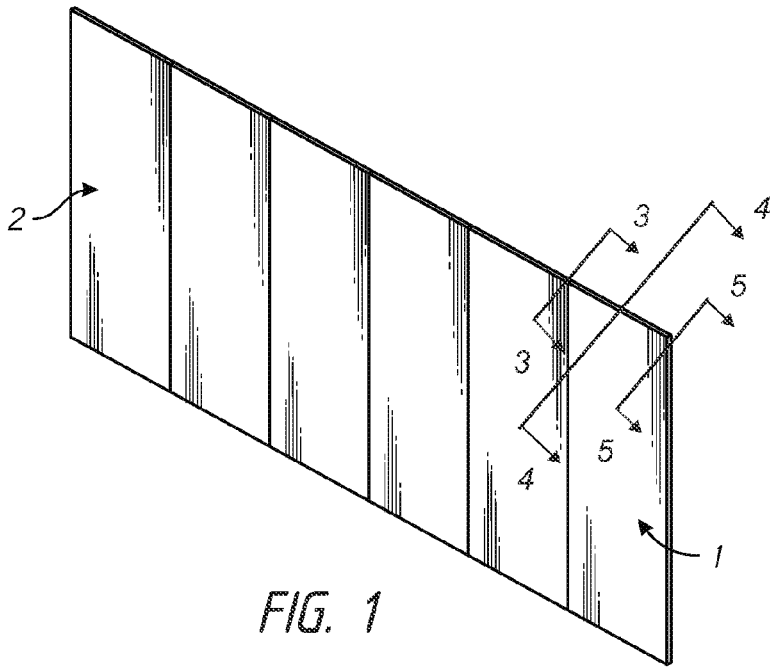
FIG. 1 represents a set of elongated panels, including the panel-door, spreading along the tracks and defining a space.
Figure 2:
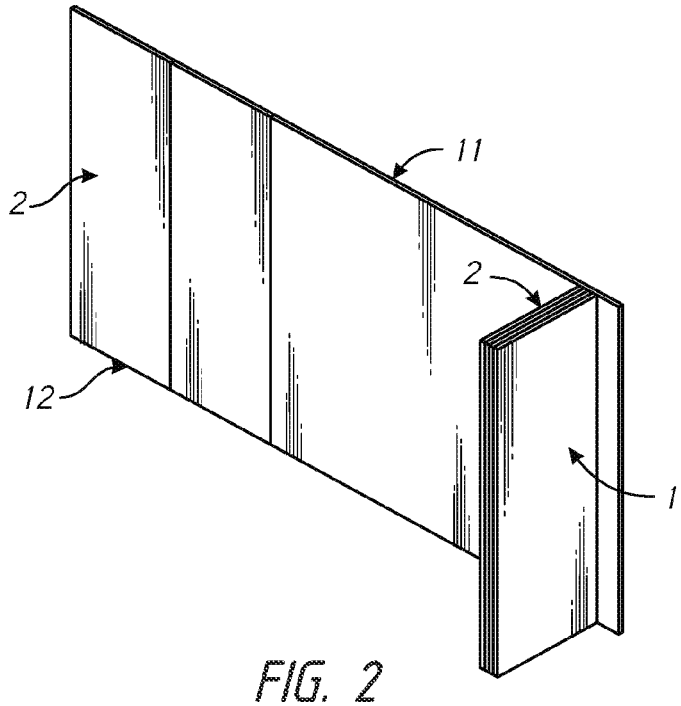
FIG. 2 represents the set of elongated panels picked up with a perpendicular positioning to the track.

In FIGS. 1 and 2 we can see the way in which the set of elongated panels (1, 2) are distributed independently along the upper (11) and lower (12) tracks. The panel-door (1) is in the nearest position to the wall, which is the last one to spread. Some of the independent panels (2) are placed next to the wall perpendicularly and folded, since this is the only position in which it is possible to fold all the panels. Other panels are arranged along the tracks (11 and 12), thus resulting in the space enclosure.

Figure 3:
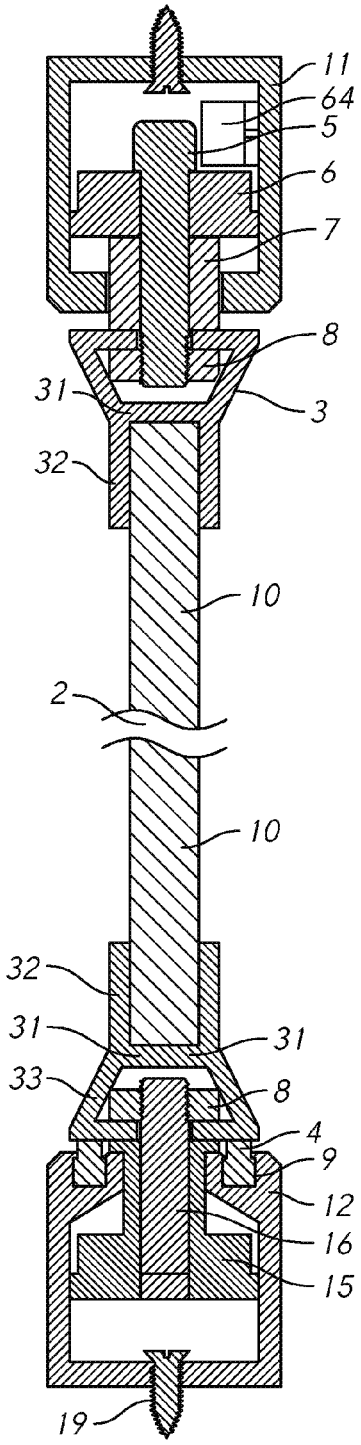
FIG. 3 represents the section of the independent panel through the first cross section.
Figure 6:
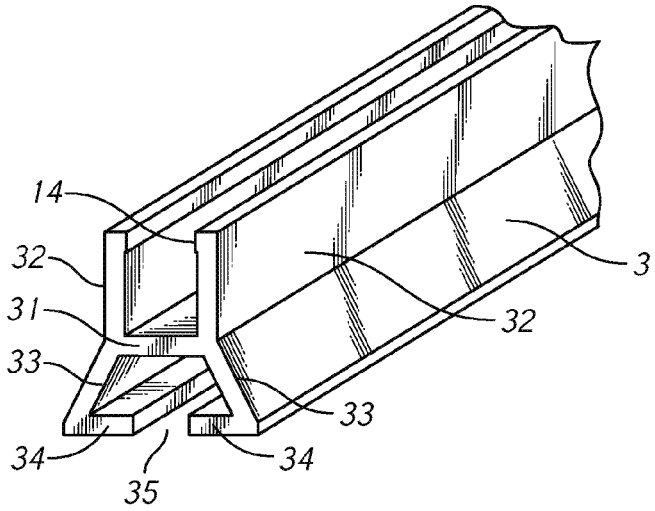
FIG. 6 shows a perspective view of the profile.

FIG. 3 shows an independent panel (2) at a first cross section. The independent panel includes an glass (10), between 10 and 30 mm wide, and the different devices included to allow the rotation of the independent panel (2) about a spin axis. The glass upper end (10) is protected by an aluminum profile (3), the end outer arms (32) of which are attached to the glass (10) and to its base (31). As shown in more detail in FIG. 6, the upper side of the profile (3) is trapezoid-shaped, with a trapezoid opening (35) located in the wide side of the trapezoid structure and limited by both extensions (34). The base (31) is the narrow side and it coincides with the ends of the profile (3) outer arms (32). The outer arms (32) and the base (31) defines the recesses (14) that improve the fitting of the glass (10).

Figure 9:
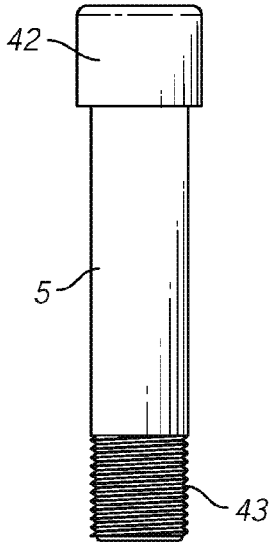
FIGS. 9 and 10 show an elevation and floor plan view of the top flag screw.
Figure 10:
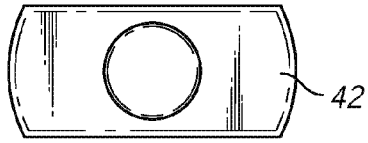
Figure 11:
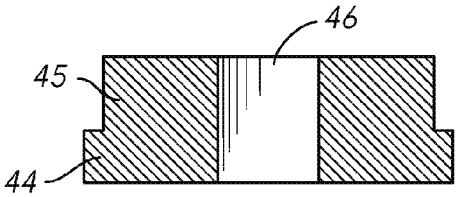
FIGS. 11 and 12 show a section and floor plan view of the circular section of the top flag.
Figure 13:
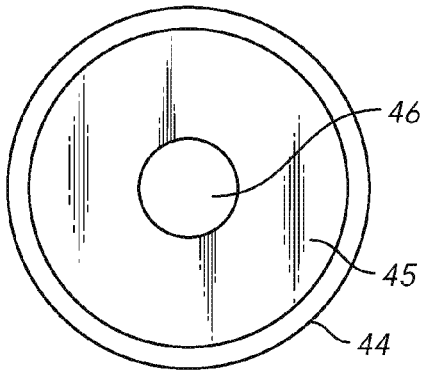
FIGS. 13 and 14 show a section and floor plan view of the cylindrical spacer piece acting as a stop.
Figure 12:
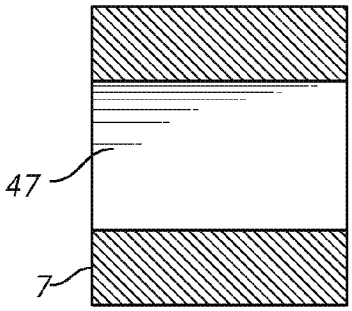
Figure 14:
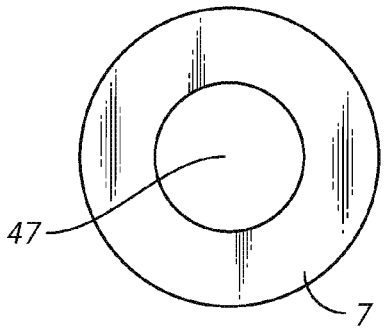
Figure 28:
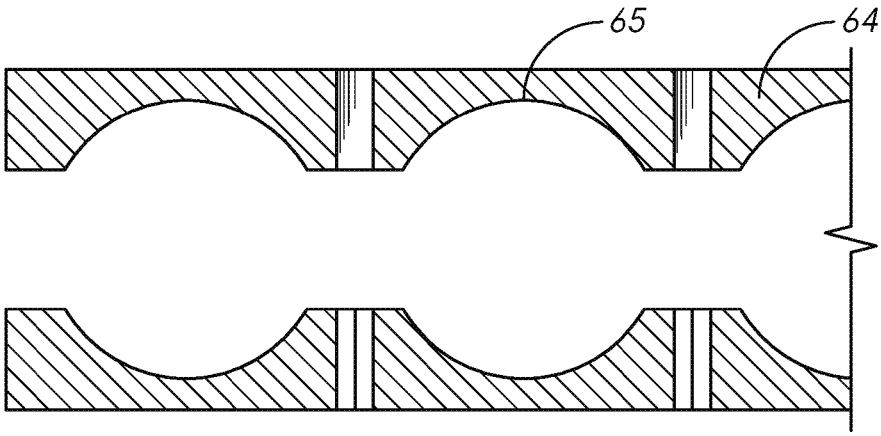

The rotation of the independent panel (2) is carried out with the help of some pieces partially located in the upper (11) and lower (12) guide tracks. Three pieces that make up an upper side of the top flag include:

a) The top flag screw (5), made up of stainless steel and with the shape of a "T". In FIGS. 9 and 10 it is shown in detail that the head or upper end (42) of the top flag screw (5) has the shape of an oval, with two straight and elongated sides so that, when it spins, it comes into contact with the inner side of the circular recess (65) of the turning mechanism (64) as seen in FIG. 28, which delimits the movement of the top flag screw (5). The base of the top flag screw is threaded (43).

b) The circular section (6) is made up of plastic; it has a circular shape and is located inside the track (11). FIGS. 11 and 12 show that the circular section (6) is a unitary piece made up of polyamide or a similar material and it consists of two cylindrical layers of different diameter. The lower layer (44) that is the base of the circular section (6) has a larger diameter and is in touch with the inner walls of the upper track (11). The upper layer (45) has a smaller diameter. Both layers (44, 45) have a central first threaded opening (46) that allows the entrance of the top flag screw (5), being the diameter of this central first threaded opening (46) that allows the entrance of the top flag screw (46). Consequently the diameter of the central first threaded opening (46) is smaller than the width of the top flag screw (5) head (42).

c) The cylindrical spacer piece (7), shown in FIGS. 13 and 14, is also made up of plastic, and it is the one in touch with the sides extensions (34) of the profile (3) and the lower layer (44) of the circular section (6), acting as stop between them. The cylindrical spacer piece (7) is centrally bored (47) to accommodate the top flag screw (5) through the central bore (47).

The circular section (6) and the cylindrical spacer piece (7) are crossed by the top flag screw (5) through the openings (46 and 47, respectively.) The top flag screw (5) head (42) is set with the circular section (6), and the base of this top flag screw (5) goes through the trapezoid opening (35) of the trapezoid structure (3) and is threaded in the upper metal sheet (8) located along the hollow inside the profile (3) trapezoid structure.

Figure 15:
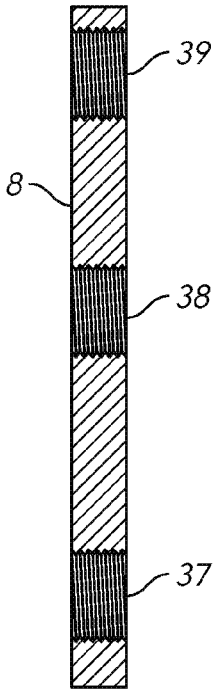
FIGS. 15 and 16 show a section and floor plan view of the metal sheet.
Figure 16:
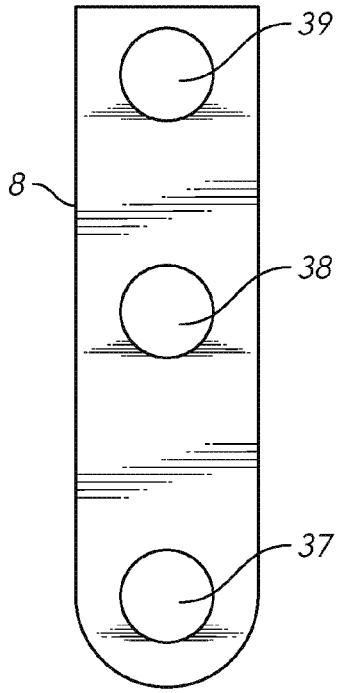

As it is shown in FIGS. 15 and 16, the upper metal sheet (8) is elongated and has three threaded holes (37, 38 and 39), of identical diameter, located along the longitudinal axis of the metal sheet (8). The sides of this metal sheet (8) are straight, except for the one located at the end of the panel-door or panel (2), which is curved. In the hole (37) made nearest to the curved side the T guide (5) is threaded, fastening the independent panel (2) to the upper track (11), with the help of the circular section (6) and the cylindrical piece (7). Thus, this upper metal sheet (8) aims to keep the profile (3) and the track (11) stuck together, with the help of the set of pieces (5, 6 and 7). The upper metal sheet is placed in a determined place along the trapezoid opening (35) of the upper profile (3) with the help of two headless worm screws, not shown in the figures, which are threaded at the edges of the extensions (34) as well as in the holes (38 and 39) of the metal sheet (8). The disposition of all these pieces is set throughout the top guide screw (5), in relation to the profile (3) of the independent panel. These components are not sized to support the weight of the independent panel (2), since it shall rest in the base of the device.

Figure 27:
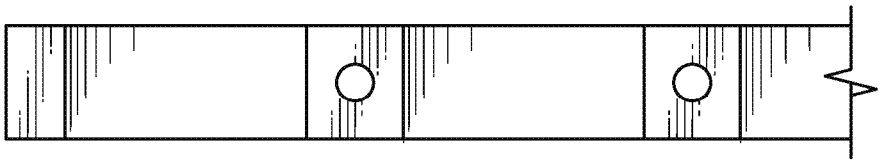
FIGS. 27 and 28 show two different views of the turning mechanism.

As seen in FIG. 3, in the vicinity of the head (42) of the top guide screw (5), a partial cut of the piece called turning mechanism (64), which is shown in detail in FIGS. 27 and 28. The turning mechanism (64) is a straight and elongated piece, higher than the head (42) of the top guide screw (5), and it has a straight side in touch with the wall of the upper track (11) to which it is attached with the help of some screws (not shown in respective figures) that go through the channels defining the circular recesses (65). The other side that looks into the track (11) is made up by a set of curved gaps or valleys defining the circular recesses (65). The turning mechanism (64) is located at the end of the track that is in touch with the wall, and from there on it extends out along the upper track (11). Its length and number of circular recesses (65) is defined by the number of panels (2) that make up the enclosure system, since each spoon (65) shall house the head (42) of the top guide screw (5) of each panel and it will help prevent that the panels rotate when they are open. That is, each circular recess (65) defines one of the points through which the top flag in which each independent panel (2) rotates passes.

Thus, each turning mechanism (64) is specifically made for each enclosure, depending on the number of panels that comprise the enclosure system, as well as the geometric characteristics of them, with the aim of establishing the point through which the top flag passes.

Figure 8:
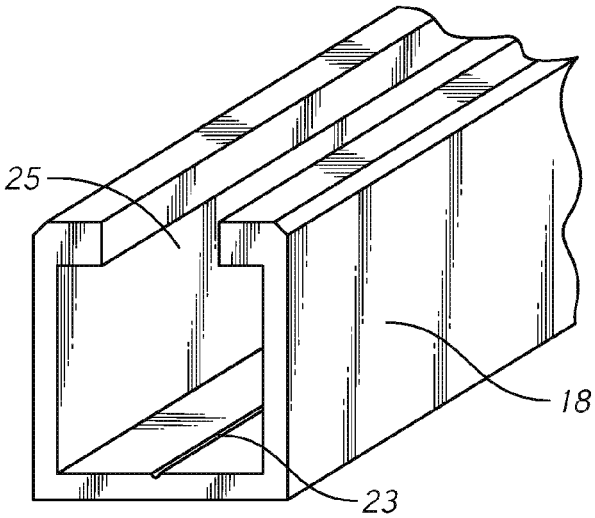
FIG. 8 shows a perspective view of the upper track.

As it is shown in detail in FIG. 8, the upper track (11) has a rectangular or squared section; one of its sides is partially closed and has a first elongated opening (25) that allows the entrance of the elements (5, 6 and 7) that constitute the upper side of the top flag, which help to rotate the independent panels (2). The first elongated opening (25) is defined by the equidistant sides of the track (11). The upper track (11) is attached to the roof by means of nails, screws or other similar elements that drill a slot in the shape of a channel (23) located in the inner face opposite to the opening (25) of the guide track (11).

Figure 19:
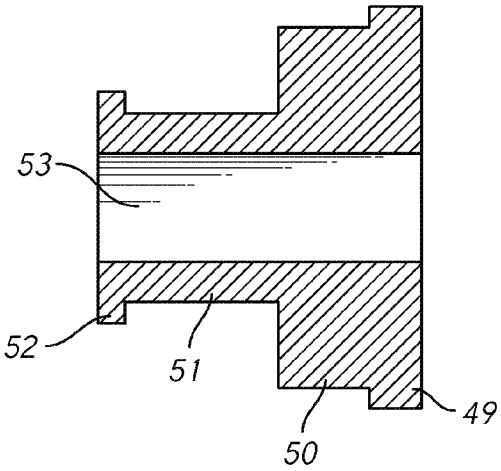
FIGS. 19 and 20 show a section and floor plan view of the bush.
Figure 20:
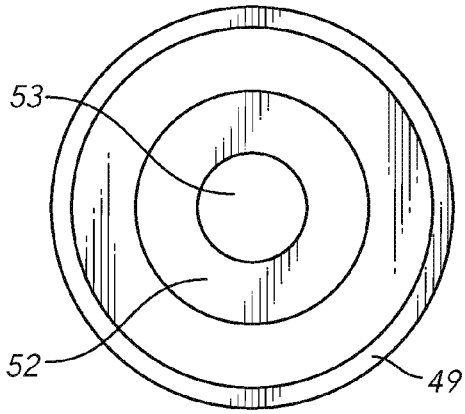

The lower side of the glass (10) is protected by an aluminum lower profile (3) similar to the upper one. The glass (10) is stuck to this profile (3) in the same way was it is stuck in the upper part. So, the upper side of the profile (3) includes the profile outer arms (32), the recess (14) and the base (31) in which the weight of the glass rests (10). From the base (31) of the profile (3) some sides (33) come out; these constitute the trapezoid structure and function as a mounting structure, since they rest on top of a channel (9) of the lower track profile (12). The wide side of the trapezoid structure is open and the base (31) corresponds to the narrow side. Within the trapezoid structure there is a lower metal sheet (8) as in the upper side of the panel. A bottom flag screw (16) is driven into this piece (8), and it goes through the bush (15), made up of polyamide or a similar material, which allows the longitudinal movement along the lower track (12). The metal sheet (8), bottom flag screw (16), and bush (15) form the bottom flag. The rotation of the bush (15) inside the lower track (12) allows the opening of the independent panels (2). FIGS. 19 and 20 show that this bush (15) is a sole unitary piece and that it consists of four cylindrical layers of different diameter, the central portion of which is hollow (53) so as to allow the entrance of the bottom flag screw (16). The first cylindrical layer (49) that makes up the base of the bush (15) and is at a lowest level of the four layers has the largest diameter and is in touch with the inner walls of the lower track (12). Subsequently, there is a second cylindrical layer (50) that functions as step between the first cylindrical layer (49) and the third cylindrical layer (51). The third cylindrical layer (50) and has a diameter being equal to a width of a second elongated opening (24) of the lower track (12). Finally, on top of the third cylindrical layer (50) a fourth cylindrical layer (52) protrudes, the diameter of which is slightly superior to the second elongated opening of the lower guide track (12), in order to avoid the bush (15) from falling into the hollow of the lower track (12). The third cylindrical layer (51) is in touch with the end protrusions (34) that define the trapezoid opening (35) of the profile (3) trapezoid structure.

With the screws (5 and 16) fastened in top and bottom flags, it is possible to make the fine adjustment of the independent panel (2) between the lower (12) and the upper (11) tracks.

Figure 7:
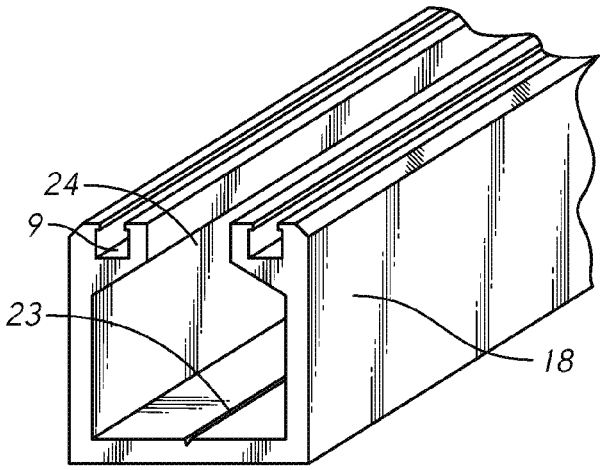
FIG. 7 shows a perspective view of the lower track.

As shown in detail in FIG. 7, the section of the lower track (12) is rectangular or squared, and its base is closed; the upper side is partially opened (24) and, through the second elongated opening (24), the elements of adjustment are introduced. The second elongated opening (24) of the lower track (12) is limited by the equidistant sides of the elongated opening (24) of the lower track (12). On these sides gaps of, for example, 4 mm are drilled, in such a way that they are equidistant to a central dividing line of the lower track, and in which the PTFE strips (4) attached to the lower channel (9) are fitted. In this way, the weight of each panel (2) rests over these PTFE strips (4). The lower track is attached to the floor similarly than to the upper track, with the help of a nail (19) or equivalent piece that goes through the longitudinal channel (23).

Figure 5:
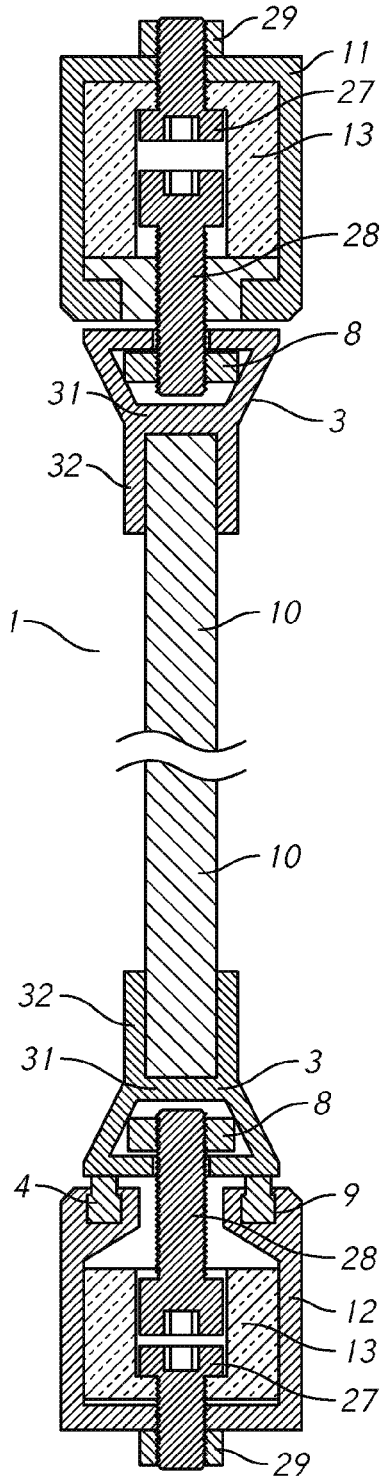
FIG. 5 represents the section of the panel-door of the enclosure system through the third cross section.
Figure 25:
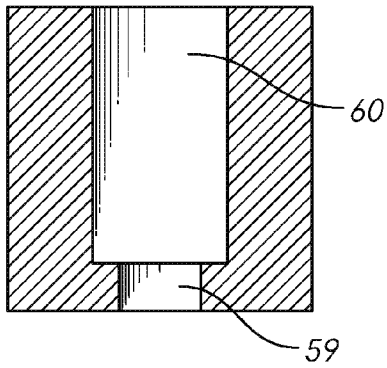
FIGS. 25 and 26 show a section and floor plan view of the square block located between the panel-door profile and the panel tracks.
Figure 26:
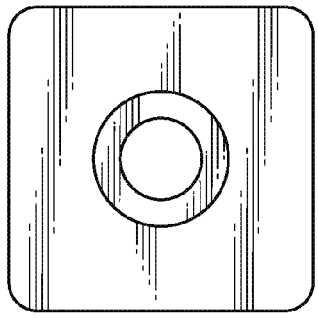

The panel-door (1) does not move along the lower and upper tracks (11 and 12), and thus the structure of the panel-door (1) is slightly different to the rest of the independent panels (2), as shown in FIG. 5 at a third cross section. The upper end of the glass (10) is protected by a profile (3) previously described, in which two end outer arms (32) are stuck to the glass (10) and to its base (31), which is trapezoid-shaped. Inside the trapezoid structure is the metal sheet (8), also previously described, to which a stop screw (27) is fastened, the head of which is found within the square block (13) that, in turn, is located inside the upper track (11). In FIGS. 25 and 26 this square block (13) is shown in detail, which is made up of polyamide or a similar material and that contains a rectangular floor plan section with rounded corners, in order to enable the attachment of this component into the lower (12) and upper (11) tracks. The inside part of this piece (13) is hollow and circular, and the heads of stop and anchoring screws (27 and 28) are located there; the threads of them come out by the lower and upper opening.

The upper opening (59) of the square block (13), which is in touch with the roof of the upper track (11), has a smaller diameter than the head of the anchoring screw (28) that goes through the roof of the side that makes up the upper track (11) and is threaded in a nut (29) located in the roof of the room. The stop screw (27) comes out through the lower opening (60), the circular side of which has a larger diameter than the heads of the stop and anchoring screws (27 and 28), which allows the fitting of the heads of both screws (27 and 28) within the square block (13). The lower side of the panel-door contains the same elements arranged between the profile (3), the base of which is trapezoidal-shaped, and the lower guide track (12). Inside the lower track (12), the square block (13) has rounded corners and is hollow, with an opening (59) that is in touch with the floor of the track (12) The opening (59) has smaller diameter than the head of the anchoring screw (28) that goes through the lower track (12) and is threaded in the nut (29) located in the floor of the room. The diameter of the opening (60) is larger than the heads of the stop and anchoring screws (27 and 28). On the other side, the head of the stop screw (27) is threaded in the metal sheet (8) located in the hollow of the trapezoid structure (3).

This set of screws, nuts (29) and square blocks (13), together with the metal sheet (8), enable the rotation of the panel-door in both ways and is in touch with the lateral sides of the open side of the upper track. With the help of the screw, the panel-door can be adjusted to the upper track. As in the rest of the panels, these components are not sized to support the weight of the panel-door, since it shall rest in the lower sides (34) of the panel-door profile which, in turn, rests on the PTFE strips (4) located along the channels (9) in the base of the device.

The panel-door (1) includes a handle (not shown in the figures), that allows the opening of the panel-door; said handle is used, together with the closure of the inner side, to open, close or block the panel-door (1), thus allowing the system to be completely shut, without making it possible to open it from the outside.

On the central side of the upper track (11), that coincides with the end of the panel-door (1), a gap is made opposite to the wall, and a turning arm (40) in the form of an arm-shaped plate (40) is used to guide the exit of the independent panels (2) and the panel-door (1). That is, the slot (48) made in the upper track (11) allows the sheets (10) and their profiles (3) to come out from the plane made up by the upper (11) and lower (12) tracks when these are picked up in the end of the enclosure system. The circular recess (65) defines the axis on which each of the panel rotates, and the turning arm (40) will help each sheet (10) to come out, allowing them to rest on it. Thus, when each independent panel (2) rotates on the spin axle made up by the devices (5, 6, 7, 8, 15 and 16) showed in FIG. 3, the sheet (10) rotates, coming out of the plane composed by the upper (11) and lower (12) tracks, with the help of the devices described below. The same occurs with the panel-door (1) when it rotates on the spin axle made up by the devices (5, 6, 7, 8, 15 and 16), shown in FIG. 5.

The turning arm (40) is inserted into the upper track (11) gap, and it comes out perpendicularly from said upper track (11) through the gap. On the end of the plate a rope is fastened (not shown in respective figures), which descends in parallel to the sheet (2) until it is adjusted to the lower track (12).

Figure 4:
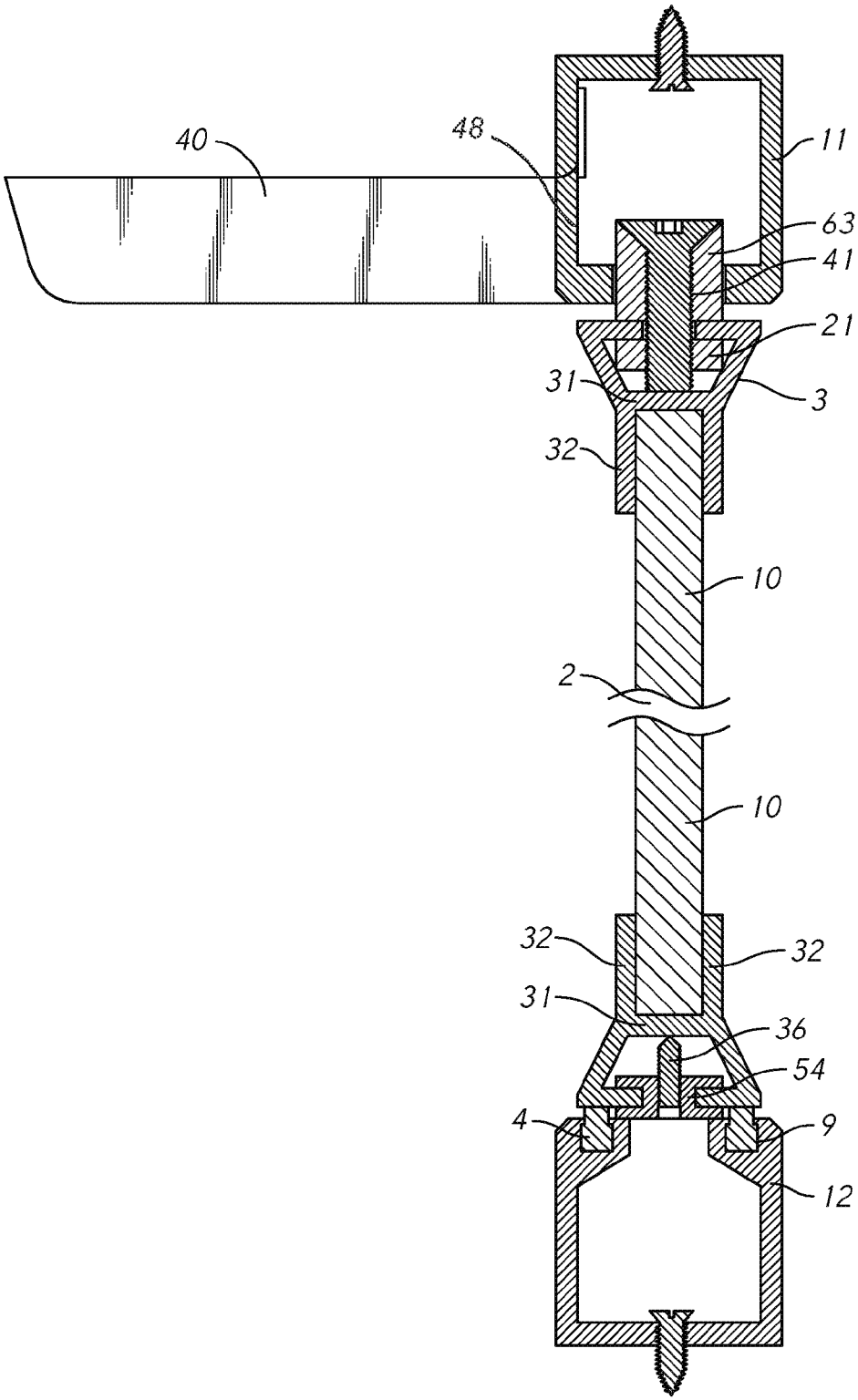
FIG. 4 represents the section of the independent panel through the second cross section.
Figure 17:
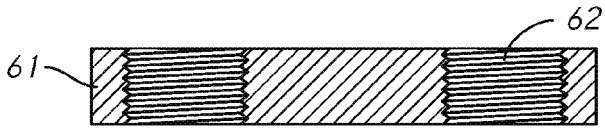
FIGS. 17 and 18 show a section and floor plan view of another metal sheet.
Figure 18:
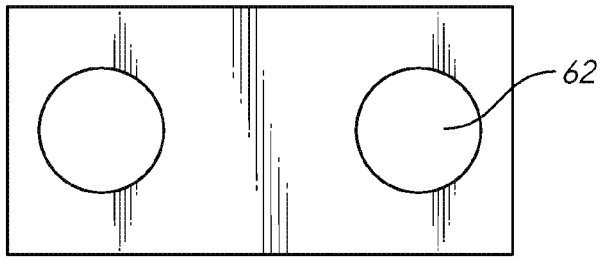
Figure 21:
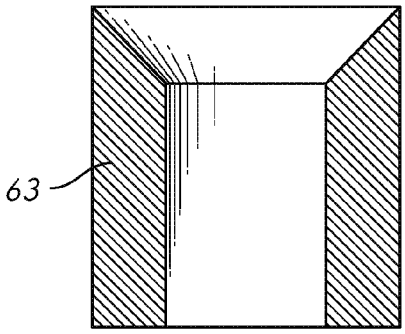
FIGS. 21 and 22 show a section and floor plan view of the cylindrical hollow piece of the top guide that comes out through the hollow of the upper track.
Figure 22:
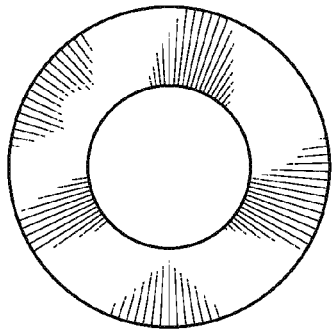

As it is shown in FIG. 4, at a second cross, the glass (10) is fitted on the profile (3) previously described of the panel-door (1) and the independent panels (2). For both the panel-door (1) and the independent panels (2), the upper side of the end which is opposite to the spin axis comprises a top guide having a top guide screw (41) that goes through a cylindrical hollow piece (63) made up of polyamide and located in the first elongated opening (25) of the upper track. This cylindrical guide piece (63) has a diameter that coincides with the opening of the first elongated opening (25). The cylindrical hollow piece (63) is shown in more detail in FIGS. 21 and 22, showing that the diameter of the inner cylinder allows the entrance of the top guide screw (41). This hollow widens on the upper part of the cylindrical hollow piece (63) until it coincides with the perimeter of the top guide screw head (41), making it fit on the cylindrical hollow piece (63) in order to enable the entrance of these pieces through the slot (48) of the upper track. The top guide screw (41) goes through the trapezoid opening (35) of the profile (3) trapezoid structure and is fastened in the thread (22) of the metal sheet (21), which is housed inside the profile (3) trapezoid structure. In FIGS. 17 and 18 you can see in more detail that the metal sheet (21) is rectangular and that it contains 2 threads (22) equidistantly located along its longitudinal axle. The metal sheet (21) is made up of stainless steel or any similar material. In the lower parts of the elongated panels, over the PTFE strip (4) located in the channels (9) of the lower track (12), the lower extensions (34) of the profile (3) trapezoid structure rest.

A bottom guide (54) made up of polyamide and with the shape of an "H", is partially introduced between the sides (34) of the profile (3) trapezoid structure, in such a way that the base of the bottom guide (54) covers the second elongated opening (24) of the lower track, but without making the weight of the independent panel (2) rest over the bottom guide (54) in the inner borders that define the second elongated opening (24) of the lower track (12). In this way, the bottom guide does not rest over the PTFE strips (4), but it does cover the second elongated opening (24) of the track (12). With the help of a bottom guide screw (36) that goes across the threaded hollow (58) through the longitudinal center of the washer (54) and up to the base (31) of the lower profile (3) trapezoid structure, the washer (54) is fastened to the profile (3).

Figure 23:
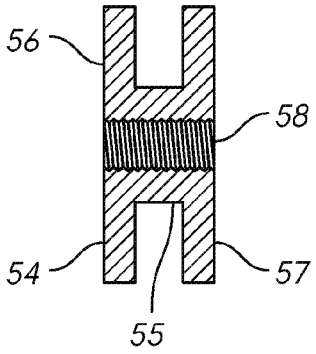
FIGS. 23 and 24 show a section and floor plan view of the bottom guide acting as washer.
Figure 24:
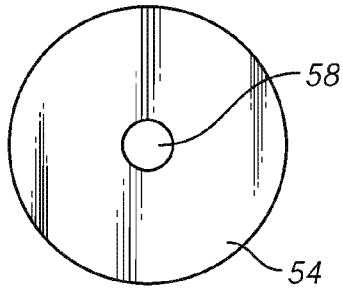

As it is shown in detail in FIGS. 23 and 24, the bottom guide (54)—over which the sheet (2) moves and rotates—has the shape of an "H", and it is a uniform piece.

The bottom guide is divided into three cylinders: two cylindrical outer layers (56 and 57) that have equal diameter—and which is larger than the second elongated opening of the lower track (12)—and a cylindrical inner layer (55), that has a much smaller diameter, which is inserted into the trapezoid opening (35) of the trapezoid structure of the lower profile (3).

The rotating movement begins when the head (42) of the top flag screw is introduced and fitted within the circular recess (65) of the turning mechanism (64). The sinking of the spoon circular recess (65) establishes and secures the exact point through which the spin axis passes and in which the spin movement of the panel-door or panel will take place. Besides, the looseness of the sinking within the circular recess (65) allows a slight swinging of the panel-door, which eases the opening of the panel (2) or the panel-door (1). When an independent panel (2) or panel-door (1) rotates, it twists through the spin axis defined by the top flag and bottom flag (5, 6, 7, 8, 15 and 16) and the first upper stop and first lower stop (8, 13, 27, 28 and 29), and the sheet rotates as well, driving the weight of the glass (10) that the profile (3) receives to the bottom guide (54) through its sides (33 and 34). When the bottom guide moves (54), it is moved above the lower track (12) second elongated opening (24), abandoning it for a notch (not shown in respective figures) made in the PTFE strip (4). On the other side, the axle top flag and the top guide that comprise the screw pieces (41) that go through the cylindrical guide piece (63) and thread into the metal sheet piece (21), can only abandon the upper track (11) through the slot (48). Thus, the screw (41), the cylindrical piece (63) and the metal sheet (21) will be at a different distance on each panel (2), in such a way that the panels that were last to rotate or be picked up will have the pieces (41, 21 and 63) nearest to the spin axle. So, the opposite end to the spin axle made up by the pieces (8, 13, 27, 28 and 29) of the panel-door (1) coincides with the axis in which the pieces (41, 21 and 63) are located. Other arrangements allow for the size of each elongated panel to be different, so that the edge which is opposite to the spin axis coincides with the place where the guide pieces are placed (41, 21 and 63).

A variant to this system consists of welding the top flag screw (5) to metal sheet (8) so as to get a higher robustness of the spin system for both the panel-door (1) and the rest of the independent panels (2).

The invention claimed is:

1. An enclosure system comprising:

a plurality of elongated panels, the plurality of elongated panels including a plurality of independent panels and a panel-door, each of the plurality of panels having a top edge, a bottom edge, and two opposing side edges extending longitudinally between the top edge and the bottom edge;

an upper track constructed and arranged to receive an upper portion of each of the plurality of elongated panels; and a lower track constructed and arranged to receive a lower portion of each of the plurality of elongated panels, the lower track including two polytetrafluoroethylene (PTFE) strips running a length of the lower track, the two PTFE strips constructed and arranged for facilitating movement of the plurality of elongated panels along the upper track and the lower track, wherein, when the plurality of elongated panels are mounted in the upper track and the lower track such that each of the plurality of panels defines a respective plane extending longitudinally between the top edge, the bottom edge, and the two opposing side edges that is parallel to a vertical plane extending between the upper and lower tracks and a side-by-side pair of lower surfaces of the lower portion of the elongated panels rests longitudinally and uniformly throughout the lower track on the two PTFE strips along the length of the track, substantially all weight of each of the plurality of elongated panels is supported evenly on the two PTFE strips, and wherein each elongated panel, and each of the upper and lower tracks is free of wheels and bearings.

2. The enclosure system of claim 1, wherein each of the plurality of elongated panels comprises:

a sheet; and two profiles, each profile having a hollow trapezoid structure and a pair of outer arms, the hollow trapezoid structure having a wide side, a narrow side, and two slanted sides, the wide side of the trapezoid structure defining a trapezoid opening centered between two extensions of the wide side, the narrow side of the trapezoid structure and the pair of outer arms defining a recess;

wherein the recess of one of the two profiles attaches to an upper portion of the sheet;

wherein the recess of another of the two profiles attaches to a lower portion of the sheet.

3. The enclosure system of claim 2:

wherein the sheet is made of tempered glass;

wherein the two profiles are made of aluminum.

4. The enclosure system of claim 2, wherein each of the plurality of independent panels comprises a top flag constructed and arranged to provide positioning and spacing for each of the plurality of independent panels, the top flag comprising:

a first metal sheet constructed and arranged to be disposed within the hollow trapezoid structure of the one of the two profiles, the first metal sheet defining a first threaded hole;

a top flag screw passing through the trapezoid opening of the one of the two profiles to connect to the first threaded hole of the first metal sheet, an upper portion of the top flag screw being disposed within the upper track;

a circular section having an upper layer and a bottom layer, the lower layer having a larger diameter than the upper layer, the lower layer being constructed and arranged to contact inner walls of the upper track, the circular section defining a central first threaded opening constructed and arranged to receive the top flag screw; and a cylindrical spacer piece disposed around the top flag screw between the circular section and the wide side of the hollow trapezoid structure of the one of the two profiles, the cylindrical spacer piece having a diameter being equal to a width of a first elongated opening of the upper track.

5. The enclosure system of claim 2, wherein each of the plurality of independent panels comprises a bottom flag constructed and arranged to provide positioning and spacing for each of the plurality of independent panels, the bottom flag comprising:

a second metal sheet constructed and arranged to be disposed within the hollow trapezoid structure of the other of the two profiles, the second metal sheet defining a second threaded hole;

a bottom flag screw passing through the trapezoid opening of the other of the two profiles to connect to the second threaded hole of the second metal sheet, a lower portion of the bottom flag screw being disposed within the lower track; and a bush constructed and arranged to contact inner walls of the lower track, the bush defining a second central threaded opening constructed and arranged to receive the bottom flag screw.

6. The enclosure system of claim 5, wherein the bush has four layers including a first cylindrical layer, a second cylindrical layer, a third cylindrical layer, and a fourth cylindrical layer, the first cylindrical layer being at a lowest level of the four layers, having a largest diameter of the four layers, and being in contact with the inner walls of the lower track, the second cylindrical layer being constructed and arranged as a step above the first cylindrical layer, the third cylindrical layer being disposed above the second cylindrical floor and having a diameter being equal to a width of a second elongated opening of the lower track, the fourth cylindrical floor being disposed above the third cylindrical floor and having a diameter being slightly larger than the width of the second elongated opening of the lower guide track and corresponding to a distance between the two PTFE strips.

7. The enclosure system of claim 2, wherein each of the plurality of independent panels comprises a top guide constructed and arranged to provide positioning and spacing for each of the plurality of independent panels, the top guide comprising:

a third metal sheet constructed and arranged to be disposed within the hollow trapezoid structure of the one of the two profiles, the third metal sheet defining a third threaded hole;

a top guide screw passing through the trapezoid opening of the one of the two profiles to connect to the third threaded hole of the third metal sheet; and a cylindrical hollow piece covering a top and side parts of the top guide screw, the cylindrical hollow piece having a diameter being equal to a width of a first elongated opening of the upper track.

8. The enclosure system of claim 2, wherein each of the plurality of independent panels comprises a bottom guide constructed and arranged to provide positioning and spacing for each of the plurality of independent panels, the bottom guide comprising:

two cylindrical outer layers and one cylindrical inner layer, a bottom of the two cylindrical outer layers being disposed between the two PTFE strips without entering the lower track, the cylindrical inner layer being disposed in the trapezoid opening of the other of the two profiles, a top of the two cylindrical outer layers being disposed within the hollow trapezoid of the other of the two profiles.

9. The enclosure system of claim 2, wherein the panel-door comprises a first upper stop and a first lower stop constructed and arranged to act as door pivot retainers, each of the first upper stop and the first lower stop comprising:

a fourth metal sheet constructed and arranged to be disposed within the hollow trapezoid structure, the fourth metal sheet defining a fourth threaded hole;

a stop screw passing through the trapezoid opening to connect to the fourth threaded hole of the fourth metal sheet; a square block disposed within one of the upper track and the lower track, the square block being constructed and arranged to provide a pivotable connection for the stop screw; and an anchoring screw constructed and arranged to fasten the square block to the one of the upper track and the lower track.

10. The enclosure system of claim 4, further comprising a turning mechanism constructed and arranged to allow plurality of independent panels to rotate through a ninety degree range, the turning mechanism mounted within the upper track and defining a plurality of circular recesses having a diameter corresponding to a diameter of the upper layer of the circular section of the top flag.

11. The enclosure system of claim 2:

wherein the upper track is a hollow rectangular pipe defining a first elongated opening in a center of a bottom side of the top track;

wherein the lower track is a hollow rectangular pipe defining a second elongated opening in a center of a top side of the bottom track.

12. The enclosure system of claim 11, wherein the two PTFE strips are embedded in the top side of the bottom track on opposite sides of the second elongated opening.

13. The enclosure system of claim 4, wherein the first metal sheet, the top flag screw, the circular section, and the cylindrical spacer are formed as a unitary structure.

14. The enclosure system of claim 5, wherein the second metal sheet, the bottom flag screw, and the bush are formed as a unitary structure.

15. The enclosure system of claim 7, wherein the third metal sheet, the top guide screw, and the cylindrical hollow piece are formed as a unitary structure.

* * * * *